United States Patent [19]

Roche

[11] Patent Number: 4,708,274

[45] Date of Patent: Nov. 24, 1987

[54] REMOVABLE TRAY APPARATUS FOR A WALKER

[76] Inventor: Cyril J. Roche, 567 Corbett Ave., San Francisco, Calif. 94114

[21] Appl. No.: 924,062

[22] Filed: Oct. 28, 1986

[51] Int. Cl.[4] ..... A61H 3/00

[52] U.S. Cl. ..... 224/273; 135/67; 108/44; 224/42.43

[58] Field of Search ..... 206/562, 563, 565; 224/273, 42.46 R, 42.43, 42.42; D7/70; 297/149, 153, 151, 155; 280/289 A; 135/67, 66, 65; 108/44

[56] References Cited

U.S. PATENT DOCUMENTS

| | | | |
|---|---|---|---|
| D. 170,237 | 8/1953 | Randall | 206/563 |
| 2,430,235 | 11/1947 | Mendenhall . | |
| 3,181,483 | 5/1965 | De Vitt et al. | 108/25 |
| 3,656,681 | 4/1972 | Goings | 206/562 |
| 3,957,071 | 5/1976 | Kenner . | |
| 4,074,683 | 2/1978 | Di Chiara . | |
| 4,105,247 | 8/1978 | Saint | 297/149 |
| 4,111,305 | 9/1978 | Thomas | 206/563 |
| 4,184,618 | 1/1980 | Jones . | |
| 4,212,493 | 7/1980 | Ledesky | 135/67 X |
| 4,491,257 | 1/1985 | Ingles | 224/42.46 R X |
| 4,659,099 | 4/1987 | Malone | 108/44 X |

FOREIGN PATENT DOCUMENTS

| | | | |
|---|---|---|---|
| 1103185 | 2/1968 | United Kingdom | 206/262 |

OTHER PUBLICATIONS

American Abbey Homecare catalog, American Hospital Supply Corporation, 17390 Brookhurst Street, Fountain Valley, CA 92728-8700, Mar. 26, 1986.

*Primary Examiner*—Henry J. Recla
*Assistant Examiner*—Robert M. Petrik
*Attorney, Agent, or Firm*—Henderson & Sturm

[57] ABSTRACT

An apparatus for use with a walker of a type having four vertically disposed legs which are adapted to contact the floor at the bottom thereof. Handles are provided on each side of the walker and first and second horizontal elongated members are disposed below each of the handles. A rigid tray is provided for extending over and above the first and second horizontal elongated members, with each side of the tray having first and second downwardly extending flanges thereon for preventing the tray from falling off of the first and second horizontal elongated members. The tray is not bolted or fastened to the walker itself so that it can be easily and quickly removed from or placed onto the first and second horizontal elongated members.

4 Claims, 6 Drawing Figures

REMOVABLE TRAY APPARATUS FOR A WALKER

TECHNICAL FIELD

The present invention relates generally to a tray for use on a walker of a type that people use to help support themselves when walking from place to place, and more particularly to such a tray which is easily attached and detached from such walker.

BACKGROUND ART

There are many handicapped people who must rely on the aid of a walker to move about from place to place. When the walker is in use, both hands of the person are needed for using the walker and it is extremely difficult, if not impossible, to carry other things at the same time of using the walker without some special device.

Since people generally prefer to do things for themselves, and further because many handicapped people using walkers do not always have other people around to help them, there is a need for a walker of a type which will permit the user to place a meal or other items on a tray for taking the tray and objects or food thereon to a place for it to be used or eaten as the case may be.

Certain walkers have been made having things permanently attached to them for carrying objects, but a common problem is that these additions to the walker change the center of gravity and make them somewhat dangerous. Furthermore, those trays permanently attached to a walker are not easily cleaned or sterilized, rendering them impractical. Furthermore, permanently attached devices tend to be cumbersome and add additional weight at times when they are not needed. Furthermore, permanently attached devices preclude having the convenience of using folding type walkers.

DISCLOSURE OF THE INVENTION

The present invention relates to an apparatus for use with a walker of a type having four vertically disposed legs which are adapted to contact the floor at the bottom thereof. Handles are provided on each side of the walker and first and second horizontal elongated members are disposed below each of the handles. A rigid tray is provided for extending over and above the first and second horizontal elongated members, with each side of the tray having first and second downwardly extending flanges thereon for preventing the tray from falling off of the first and second horizontal elongated members. The tray is not bolted or fastened to the walker itself so that it can be easily and quickly removed from or placed onto the first and second horizontal elongated members.

An object of the present invention is to provide a tray for a walker which is located at the walker's center of gravity directly beneath the hands of the person using the walker.

A further object of the present invention is to provide a tray for a walker which facilitates greater control, greater safety, greater ease of use and practically eliminates the possibility of spillage of food disposed thereon.

A still further object of the invention is to provide a tray for a walker which can easily be washed or sterilized.

A further object of the present invention is to provide a tray of the aforementioned type whereby the user can actually dine directly from the tray.

A still further object of the invention is to provide a tray useful for carrying a meal but which is also useful for sewing, writing, reading, or the like.

Other objects, advantages, and novel features of the present invention will become apparent from the following detailed description of the invention when considered in conjunction with the accompanying drawings.

BEST MODES FOR CARRYING OUT THE INVENTION

Figure 1:
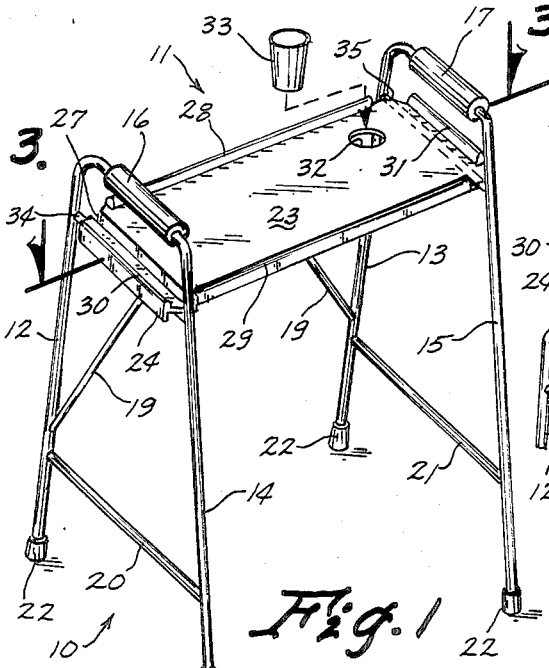
FIG. 1 is a perspective view of the present invention shown as it would be used for carrying a meal from place to place.
Figure 2:
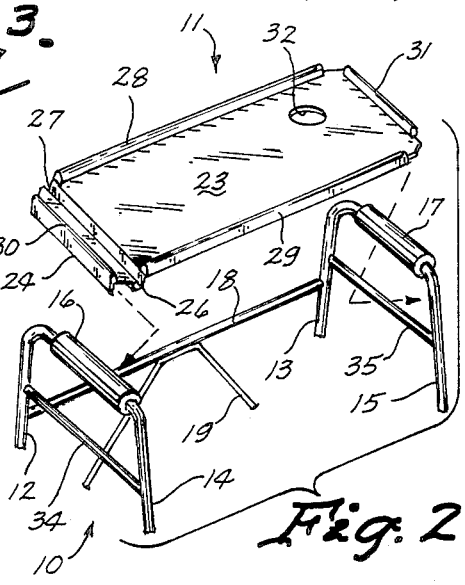
FIG. 2 is an exploded perspective view showing how the tray can be removed from or attached temporarily to a walker.

Referring now to the drawings, wherein like reference numerals designate identical or corresponding parts throughout the several views, FIG. 1. shows a walker (10) having a tray apparatus (11) removably disposed thereon for use in carrying objects such as food or the like from place to place. The walker includes front legs (12 and 13) and rear legs (14 and 15). Handles (16 and 17) are attached around where the top of the front and rear legs (12 and 14 and 13 and 15), respectively, are connected together. A brace (18), as shown in FIG. 2, connects the forward legs (12 and 13) and is also connected to another brace (19) for further bracing the front of the walker (10). Additional braces (20 and 21) reinforce and make the bottom of the walker more rigid by interconnecting a lower portion of legs (12 and 14 and 13 and 15), respectively. Conventional rubber caps (22) are disposed on the bottom of each of the legs for preventing slippage.

Figure 5:
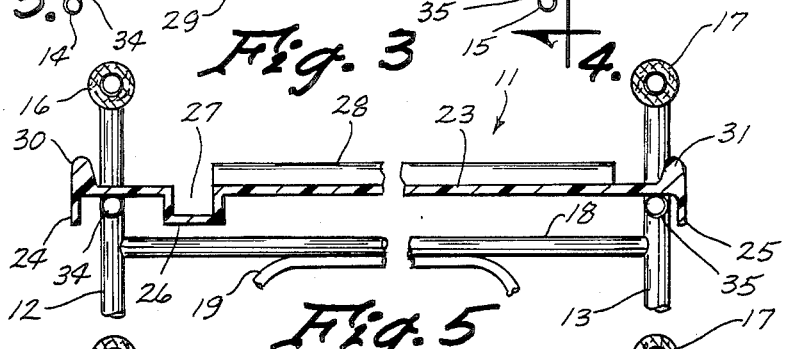
FIG. 5 is a cross sectional view taken along line 5—5 of FIG. 3.

The tray (11) includes a flat central portion (23) with downwardly extending flanges (24 and 25) which can best be seen in FIG. 5. A third downwardly extending flange (26) is somewhat U-shaped and forms a groove (27) in the top of the tray (11).

Figure 3:
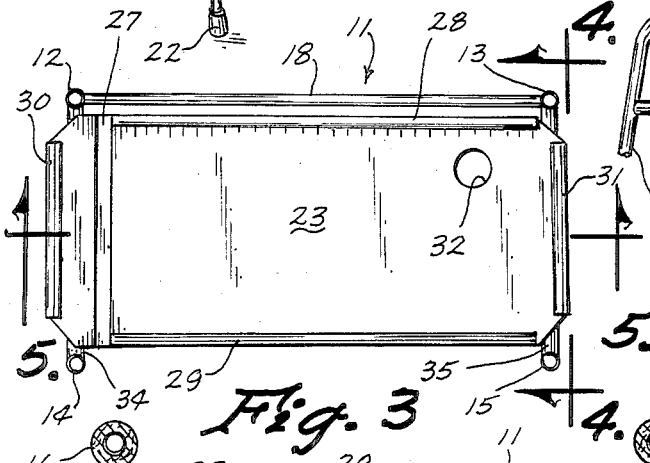
FIG. 3 is a cross sectional view taken along line 3—3 of FIG. 1.

Upwardly extending flanges (28, 29, 30 and 31) are provided for preventing objects disposed on the flat surface (23) from sliding off of the edge thereof. A hole (32) is cut through the flat member (23) as can readily be seen in FIGS. 1, 2 and 3. This hole (32) is for the purpose of holding a glass (33) which is of a frusto-conical type so that the bottom portion thereof will fit through the hole (32), but an upper portion of the container (33) will be too large to pass through the opening (32) and will support the container (33) so that it can be taken from place to place on the walker as shown in FIG. 1.

Figure 4:
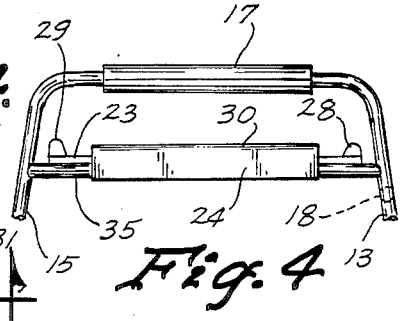
FIG. 4 is a view taken along line 4—4 of FIG. 3.

Referring to FIGS. 2, 4 and 5, it is noted that a first horizontal elongated member (34) is ridigly attached at the ends thereof to the front leg (12) at one end thereof and to the rear leg (14) at the other end thereof. Another second horizontal elongated member (35) is rigidly attached at one end to the front leg (13) and at the other end to the rear leg (15) just below the handle (17). In order to use the tray (11) as shown in FIG. 2, one end thereof, for example the end with the flange (30) thereon can be slipped under the handle (16) and then the tray (11) can be moved to the right so that the flange (25) passes over the second horizontal elongated member (35) so that it can come to rest in the position shown in FIGS. 1, 3 and 5. In this position, the first and second flanges (24 and 25) prevent the tray (11) from moving from one side to the other, and this is aided to some extent by the third flange (26). Also, the tray is prevented from sliding off the front of the walker (10) because it would first come in contact with the front legs (12 and 13), and similarly, the tray (11) is prevented from sliding off of the rear of the walker because it would first come into contact with the rear legs (14 and 15).

Once the tray (11) is in the position shown in FIG. 1, then the person using it can place a container (33) full of liquid into the opening (32) and then place a plate of food, for example, onto the top of the flat surface (23). Then the walker (10) can be used in a conventional fashion by having its user hold onto the handles (16) with the left hand and the handles (17) with the right hand taking a step or two forward, then picking up the walker (10) and placing it securely in front of them whereby they can take a step or two forwardly. This process is of course repeated until the person gets to the desired place. Once a person using the apparatus shown in FIG. 1 arrives at their destination, they can sit in a chair and the tray (11) will be in approximately the proper height for allowing them to eat therefrom as though they were eating from a dining room or kitchen table. Then when the meal is complete, a reverse procedure can be used to get the dishes back to the place where they can be cleaned or disposed of. After that is accomplished, then the tray can be removed from the walker (10) by merely picking it up and sliding it to one side or the other and then pulling it up through the center between the handles (16 and 17) where it can be stored and the walker can be used without the additional weight of the tray thereon.

Figure 6:
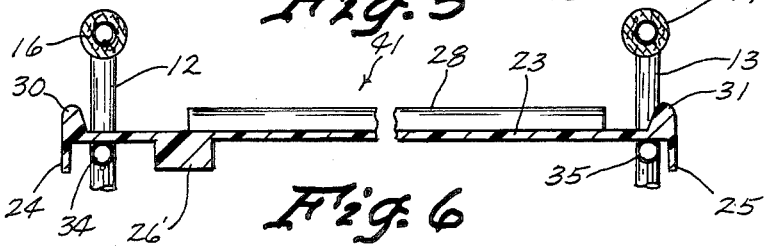
FIG. 6 is an alternate form of the invention and showing it in cross section similar to the FIG. 5 embodiment.

Referring now to FIG. 6, an alternate embodiment (41) is shown, but it is substantially identical to the tray of FIG. 5, except that the flange (26') does not have a groove in it like the groove (27) in projection (26) of FIG. 5. The use of the FIG. 6 embodiment is substantially identical to the use described above of the embodiment shown in FIGS. 1–5.

Accordingly, it will be appreciated that the preferred embodiments do indeed accomplish the aforementioned objects. Obviously, many modifications and variations of the present invention are possible in light of the above teachings. It is therefore to be understood, that within the scope of the appended claims, the invention may be practised otherwise than as specifically described.

I claim:

1. An apparatus in combination with a walker of a type including four substantially vertically disposed legs adapted to contact the floor at the bottom thereof, brace means for interconnecting the four legs together, handle means connected to respective ones of said legs, one each side of the top of the walker for permitting a user to grasp one of said handle means with each hand, a first horizontal elongated member disposed below one of said handle means and extending from one of said legs toward another of said legs, and a second horizontal elongated member disposed below the other of said handle means and extending parallel to said first horizontal member and toward another of said legs, said apparatus consisting of:

a generally rectangular rigid tray means for extending over and above said first and second horizontal elongated member;

each side of said tray means having first and second downwardly extending elongated flange means extending on the outside of respective ones of said first and second horizontal elongated members for preventing said rigid tray means from falling off said first and second horizontal elongated members;

a third downwardly depending elongated flange means attached to said rigid tray means and extending parallel and adjacent to but spaced from said first downwardly extending flange, said third flange being disposed between said first and second horizontal elongated members but closer to the first than to the second horizontal elongated member; and, said downwardly depending flange means permitting said rigid tray means to be easily and quickly removed from or placed on said first and second horizontal elongated members.

2. The apparatus of claim 1 including an upwardly extending flange on each upper and outer edge of said rigid tray means for preventing food from falling off of said rigid tray means.

3. The apparatus of claim 2 including a circular hole means extending through said rigid tray means for receiving a frusto-conically shaped container for holding liquids.

4. The apparatus of claim 3 including a groove disposed in the top of said rigid tray means just above said third downwardly depending flange means.

* * * * *